US006679138B2

(12) United States Patent
Battles et al.

(10) Patent No.: US 6,679,138 B2
(45) Date of Patent: Jan. 20, 2004

(54) BOTTLE OPENER

(75) Inventors: Christopher Battles, New Haven, CT (US); Paul Decesare, Easton, CT (US)

(73) Assignee: Start, LLC, Norwalk, CT (US)

( * ) Notice: Subject to any disclaimer, the term of this patent is extended or adjusted under 35 U.S.C. 154(b) by 0 days.

(21) Appl. No.: 10/241,930

(22) Filed: Sep. 11, 2002

(65) Prior Publication Data

US 2003/0061912 A1 Apr. 3, 2003

Related U.S. Application Data

(60) Provisional application No. 60/325,951, filed on Sep. 28, 2001.

(51) Int. Cl.[7] ..... B67B 7/14

(52) U.S. Cl. ..... 81/3.44; 81/90.2; 81/97; 81/99; 7/151

(58) Field of Search ..... 81/3.44, 3.4, 3.36, 81/3.37, 3.29, 59.1, 53.2, 57.2, 90.2, 3.09, 98, 99, 92, 94, 97; 7/151

(56) References Cited

U.S. PATENT DOCUMENTS

| | | | | | |
|---|---|---|---|---|---|
| 422,526 | A | * | 3/1890 | Heinin | 81/3.44 |
| 755,081 | A | * | 3/1904 | Twining | 81/3.44 |
| 833,222 | A | * | 10/1906 | Kimmel | 81/3.44 |
| 921,250 | A | * | 5/1909 | Hough | 81/3.44 |
| 1,110,908 | A | * | 9/1914 | Dickerman | 81/3.44 |
| 1,111,998 | A | * | 9/1914 | Duvall | 81/3.44 |
| 1,162,197 | A | * | 11/1915 | Wahlstrom | 279/72 |
| 1,192,136 | A | | 7/1916 | Stone | |
| 1,448,064 | A | * | 3/1923 | Hammann | 81/3.42 |
| 1,593,947 | A | | 7/1926 | Miller | |
| 1,913,535 | A | * | 6/1933 | Cressey | 81/3.44 |
| 2,002,906 | A | * | 5/1935 | Mullan | 81/3.44 |
| 2,052,641 | A | * | 9/1936 | McCready | 81/3.42 |
| 2,463,525 | A | | 3/1949 | Deming | |
| 2,499,032 | A | | 2/1950 | Niblett | |
| 2,524,434 | A | | 10/1950 | Duket | |
| 3,066,559 | A | | 12/1962 | Harvel et al. | |
| 4,193,508 | A | | 3/1980 | Cziraki | |
| 4,523,497 | A | | 6/1985 | Rosberg et al. | |
| 4,643,053 | A | | 2/1987 | Rhodes | |
| 4,676,125 | A | * | 6/1987 | Ardelean | 81/53.2 |
| 4,967,622 | A | | 11/1990 | Phillips | |
| 4,970,917 | A | | 11/1990 | McCollom | |
| 5,115,699 | A | * | 5/1992 | Mertens | 81/59.1 |

* cited by examiner

*Primary Examiner*—Joseph J. Hail, III
*Assistant Examiner*—Hadi Shakeri
(74) *Attorney, Agent, or Firm*—Bachman & LaPointe

(57) ABSTRACT

Bottle cap removal device with an opening therein to receive a bottle cap, including a top and a base which combine to provide an envelope for the bottle cap removal device and including an annular member and a surface opposed to the annular member operative to apply increased gripping forces on the bottle cap upon relative rotation between the annular member and bottle cap, thereby efficiently removing the bottle cap.

14 Claims, 7 Drawing Sheets

BOTTLE OPENER

CROSS-REFERENCE TO RELATED APPLICATION

This application claims the benefit of U.S. Provisional Application Ser. No. 60/325,951, filed Sep. 28, 2001.

BACKGROUND OF THE INVENTION

The present invention provides a bottle cap removal device and process for opening bottle caps of the type particularly those having a threaded connection to a receptacle, as for example, plastic soda bottles.

It is well known that the release of twist-off caps is usually very difficult due to the fact that the cap is tightened in a factory so as to avoid the escape of liquids or gas. Frequently also a safety ring adds to the difficulty due to the fact that twisting of the cap is required to break the safety ring.

It is a particular objective of the present invention to provide an improved bottle cap removal device and process which will reduce the hand strength needed to open a screw cap by means of firmly gripping the cap and providing substantial leverage. In addition, it is an objective of the present invention to enable the user to easily grip the removal device and that the removal device may be conveniently and easily stored. It is a further objective of the present invention to provide an instrument as aforesaid which is simple and convenient to use and which effectively and readily enables removal of the bottle cap.

The following references teach various removal devices: U.S. Pat. Nos. 1,192,136; 2,499,032; 4,193,508; 4,967,622; 1,593,947; 2,524,434; 4,523,497; 4,970,917; 2,463,525; 3,066,559; and 4,643,053.

While prior art designs may be suitable for a particular purpose, they are not readily suitable for conveniently and easily opening bottle caps as aforesaid. Prior art devices may provide a substantial mechanical advantage by means of tangentially extending handles; however, they often place considerable emphasis on the mechanical advantage rather than the means for gripping the cap which is to be removed. In addition, many bottle opening devices require a downward gripping force to be applied to the cap while simultaneously applying a rotating or twisting force. This is clearly inconvenient, awkward and difficult to achieve without a concentrated effort. It is desirable to provide a bottle cap removal device and process which only requires rotational movement. Frequently, a problem in removing the cap is to provide sufficient gripping forces on the cap. It is an objective of the present invention to provide considerable gripping forces on the cap as for example by means of actively engaging means which compress the cap as well as providing an adequate mechanical advantage.

Accordingly, it is a principle objective of the present invention to provide an improved bottle cap removal device and process which achieves the foregoing objectives and is simple and convenient to utilize.

SUMMARY OF THE INVENTION

In accordance with the present invention, an improved bottle cap removal device and process is provided which achieves the goals set forth hereinabove. The bottle cap removal device of the present invention preferably includes a contoured top and a base which combine to provide an envelope for the bottle cap removal device while also providing a lever arm to produce the necessary mechanical advantage in order to reduce hand stress.

In accordance with the present invention, the bottle cap removal device comprises: a body having a portion with an opening therein for receiving the bottle cap, a first portion on one side of the open portion, and a second portion on the opposed side of the open portion; an annular member in at least one of said first and second portions for engagement with a bottle cap disposed in the open portion, and a second surface opposed to said annular member for engagement with said bottle cap in opposition to said annular member; and means for applying increased gripping force on said bottle cap by said annular member upon relative rotation between said annular member and bottle cap.

Further features and advantages of the present invention will appear hereinbelow.

BRIEF DESCRIPTION OF THE DRAWINGS

The invention will be better understood by reference to a drawing in which.

DESCRIPTION OF PREFERRED EMBODIMENTS

Figure 1A:
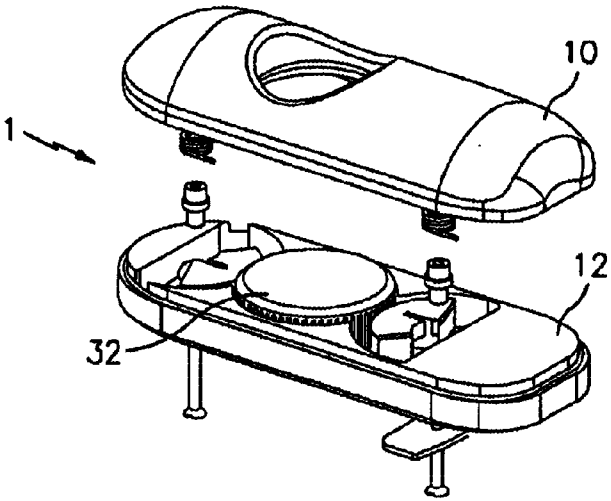
FIG. 1*a* is a similar view of the bottle cap removal device.

The present invention will be discussed in connection with the enclosed drawings wherein like reference numerals refer to like components.

Figure 2:
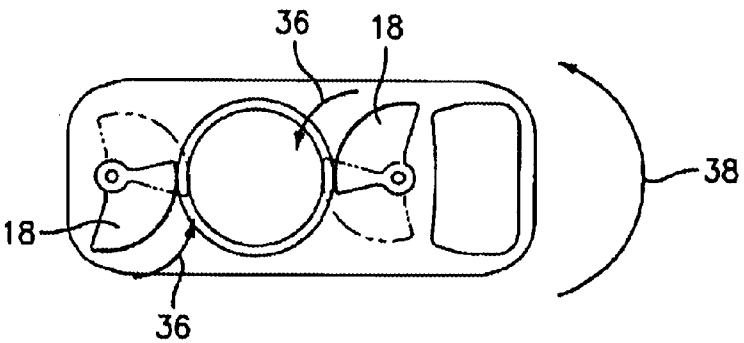
FIG. 2 is a bottle view graphically representing the automatic cam motion as the handle is rotated.
Figure 1:
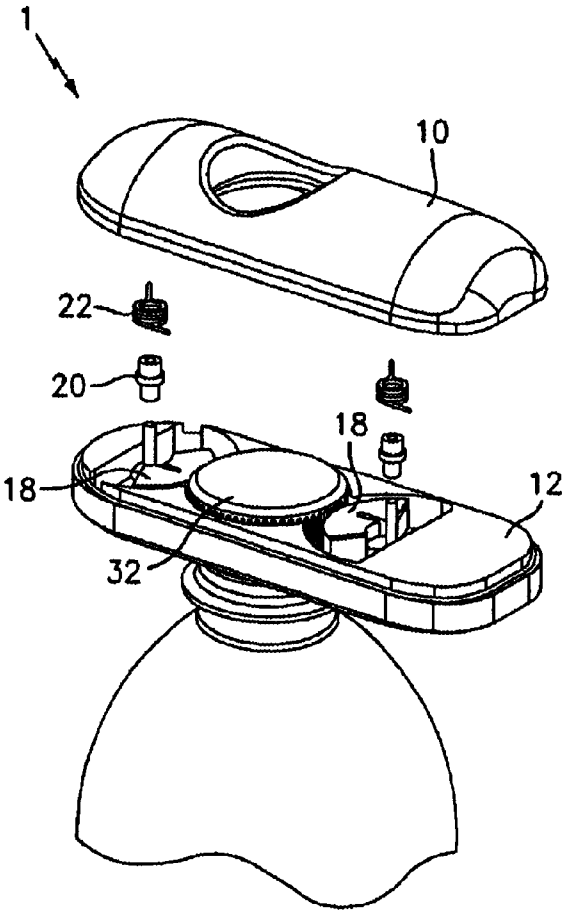
FIG. 1 is a perspective view of the present invention positioned on a bottle with the interior components exploded.
Figure 3:
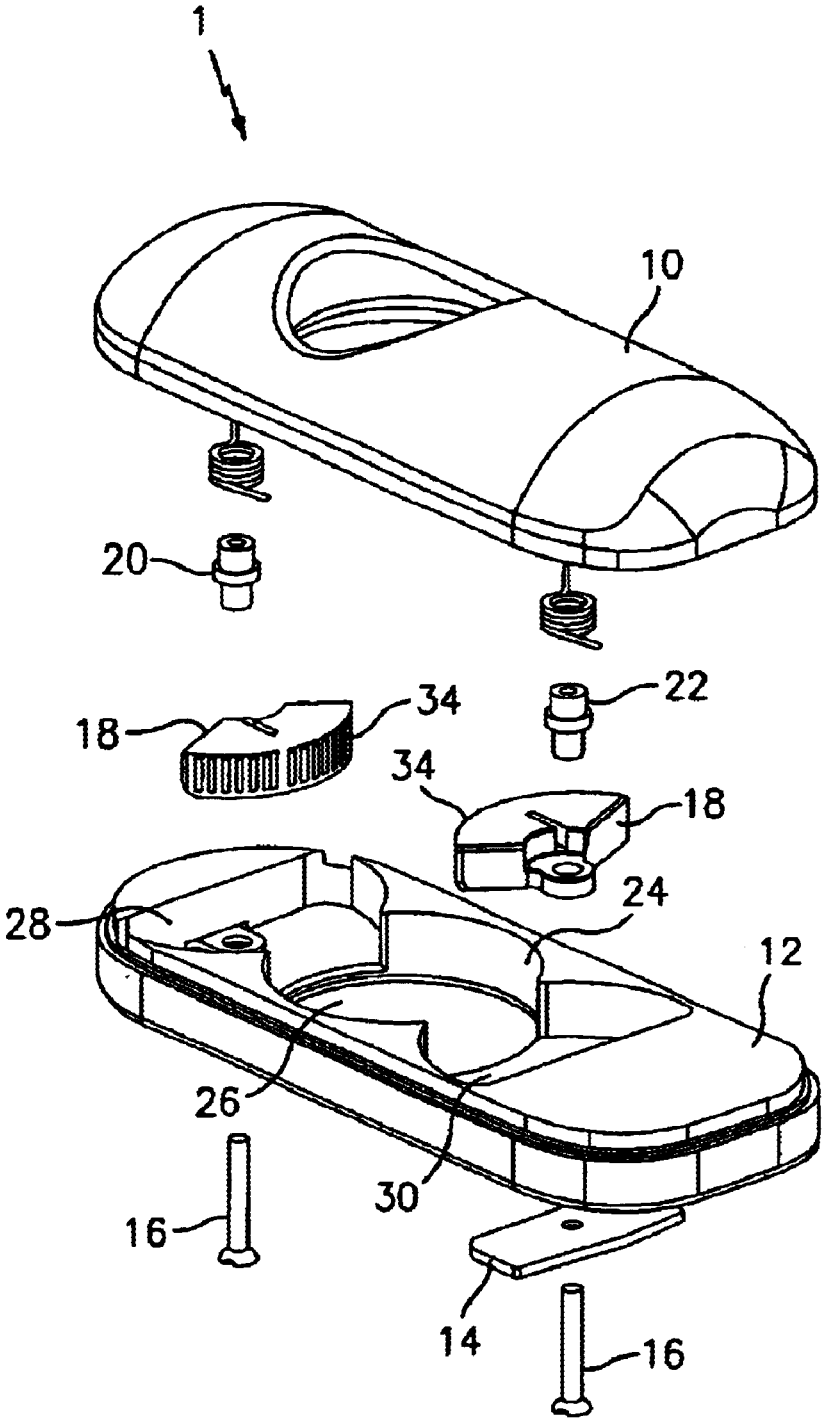
FIG. 3 is an exploded perspective view of the present invention illustrating the interior components.

Reference should be had to FIGS. 1–3 and particularly to FIG. 3, which show the preferred embodiment of the opener. The embodiment shown therein includes the following components: an opener 1 which includes an ergonomically contoured top 10 and base 12; insert for crimped type bottle cap removal 14; flat head screws 16; cams 18; bushings 20; and torsion springs 22. The base 12 and top 10 combine to provide the envelope for the opener 1 while also providing a lever arm to produce the necessary mechanical advantage to reduce hand stress. Base 12 and top 10 are desirably separable for repair or adjustment. Gripping the bottle cap is accomplished by means of the two cams 18. Opener 1 includes an open portion 24 with opening 26 therein, a first portion 28 on one side of the opening and a second portion 30 on the opposed side of the opening. The open portion is desirably centrally located in the opener, although it may be located off-center. When a bottle cap 32 is placed in the open portion 24 of the opener as shown in FIG. 1 the cams 18 engage the surface of the bottle cap 32. The distance between the tangent edges 34 between the cams 18 reduce as the opener is rotated in a counter-clockwise direction 36 as shown in FIG. 2, which also shows the initial cam position and the direction of handle rotation 38. Cams 18 move closer together as the opener is rotated as clearly shown in phantom in FIG. 2, and thus, apply an increasing gripping force on the bottle cap 32 as the opener 1 is rotated. Screws 16, as the two screws shown in FIGS. 1 and 3, will provide a means to fasten the base 12 to the top 10 as well as a support for the cams 18, bushings 20, and the torsion springs 22. The torsion springs 22 allow for controlled motion of the cams 18 in both directions while also providing a consistent reference position for the cams 18. The distance between the tangent edges 34 of the two cams 18 is smaller than the outside diameter of the cap 32. This provides an initial preload on the torsion springs 22 when a bottle cap 32 is placed in the opening 26 of the opener. A bearing surface for the cams is provided by the bushings 20. The bushings 20 provide a mandrel for the torsion springs 22 and prevent the base 12 and top 10 interface from compressing the cams 18 and restricting their movement.

Figure 4:
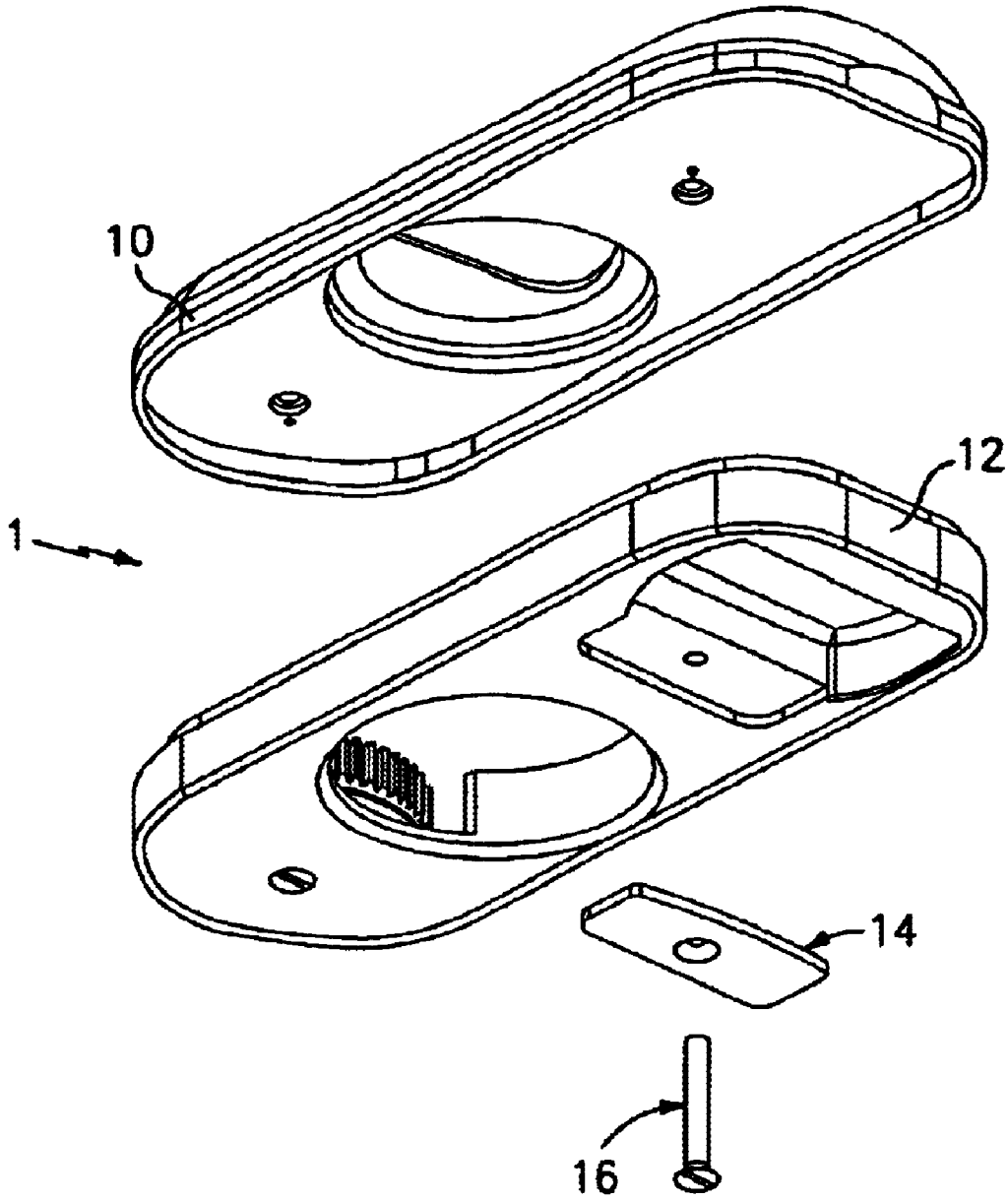
FIG. 4 is an exploded perspective view of the present invention illustrating the bottom components.
Figure 5:
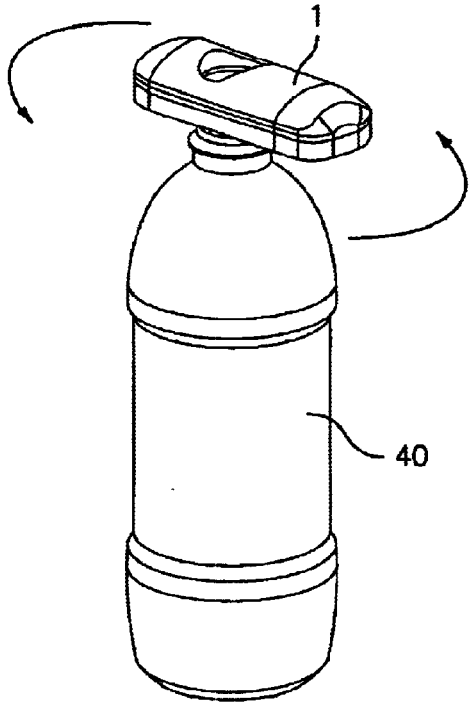
FIG. 5 is a perspective view illustrating the opener of the present invention on a twist-off cap of a plastic bottle.
Figure 6:
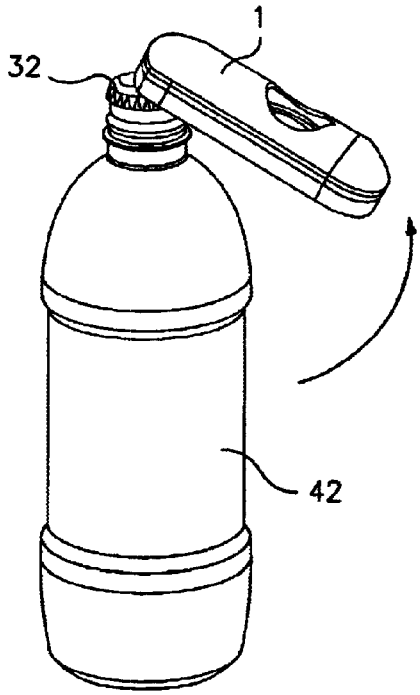
FIG. 6 is a perspective view illustrating the opener of the present invention applied to a crimped-on bottle cap of a glass bottle.

FIG. 4 shows an exploded, perspective view of opener 1, clearly showing top 10 and base 12, as well as insert 14 and screw 16. FIGS. 5–6 are perspective views, showing opener 1, with top and base portions assembled, with FIG. 5 showing opener 1 positioned on the cap of a plastic bottle 40 for cap removal, and FIG. 6 showing opener 1 for removal of a crimped on cap 32 of a glass bottle 42.

Figure 7:
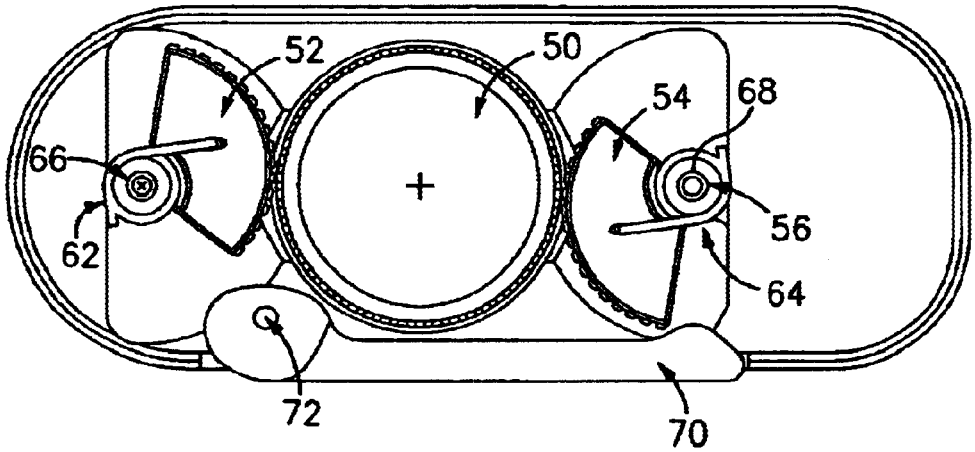
FIGS. 7–13 show alternate embodiments of the present invention.
Figure 8:
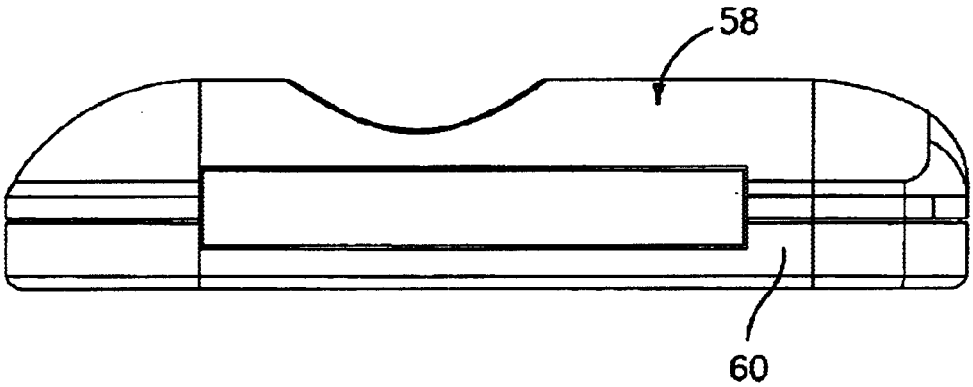

Specifically, referring to FIGS. 7–8, these describe an alternative to the preferred embodiment shown in FIGS. 1–3 which allows for the accommodation of a larger range of differing bottle cap sizes. The cap 50 is acted on by two opposing cams 52, 54 which pivot about bosses 56 in the upper 58 and lower 60 handle or opener housings. The cams 52, 54 are spring biased by torsion springs 62, 64 which are supported on bushings 66, 68. The biasing force is such that the cams 52, 54 are forced to swing in a direction that decreases the distance between tangent surfaces. An engagement lever 70 is provided, which when rotated about pivot pin 72, encounters the primary cam 52 and causes a rotation in opposition to the spring force generated by the torsion spring 64, effecting contact between the cam 52 and the bottle cap 50. Once the cams have contacted the bottle cap 50 and a rotational motion of the device in the direction of loosening of the bottle cap is initiated, the friction between the cams 52, 54 and the bottle cap 50 causes both cams to continue to rotate in opposition to the torsion springs 62, 64, reducing the tangential distance between opposing cam surfaces and thereby firmly gripping the bottle cap 50. As rotation of the opener or handle is continued, the motion is translated to the efficient and expeditious loosening of the aforementioned cap 50.

Figure 9:
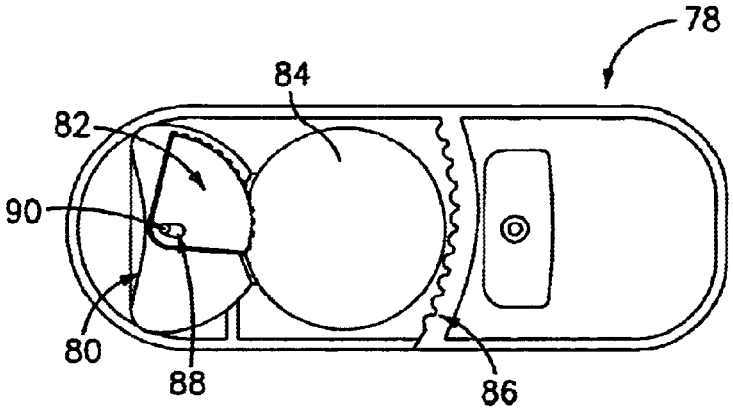
Figure 10:
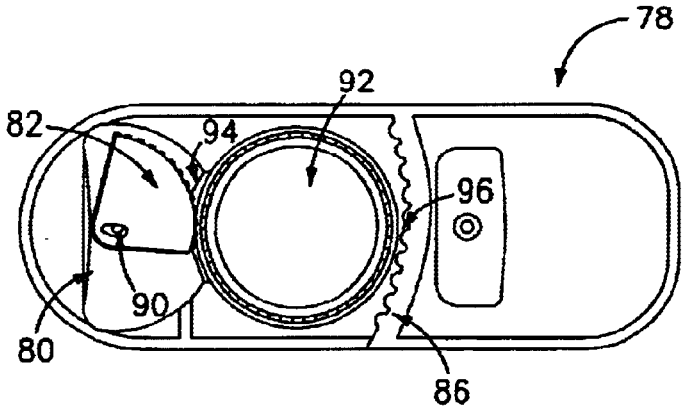
Figure 11:
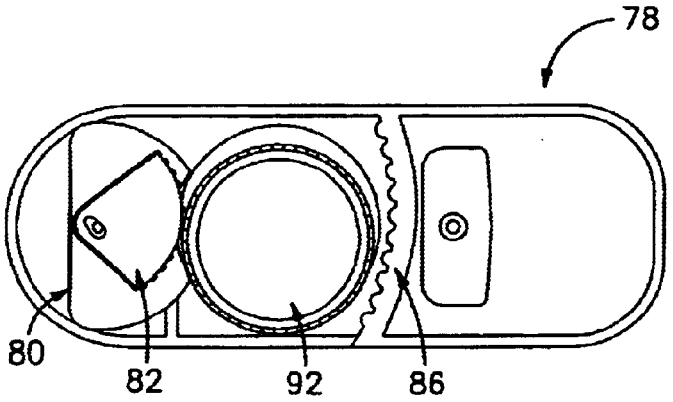

FIGS. 9–11 show a modified opener 78 and describe a further alternative embodiment of the present invention which allows for the accommodation of a range of differing bottle cap sizes. This however can be accomplished with a single cam, as opposed to the two-cam configurations described above. Referring to FIG. 9, leaf spring 80 acts on the single cam 82 biasing it towards the median aperture 84 of the device such that the distance from the tangent line of the cam 82 and the opposing stationary gripping surface 86, which is desirably of annular configuration, is slightly less than the diameter of the smallest bottle cap the opener is designed to accommodate. An extended or elongated pivot hole 88 in cam 82 allows for this cam motion relative to fixed pivot pin 90. As a bottle cap 92 is inserted into aperture or opening 84, cam 82 is displaced while continuing to be biased against bottle cap 92 by the deformation of the leaf spring 80. The bottle cap 92 is then maintained in contact with both the cam 82 and the stationary gripping surface 86 at points 94 and 96. As the opener 78 is rotated in a direction in accordance with the direction of the loosening of bottle cap 92, the friction acting on cam 82 causes the cam to be rotated about the pivot pin 90 and the apex of the contact surface between the now fully deflected leaf spring 80 and the cam 82. This rotation decreases the tangential distance between the cam surface and the stationary gripping surface, thereby firmly gripping the bottle cap 92. As rotation of the handle in the opening direction is continued, the motion is translated to the efficient and expeditious loosening of the aforementioned cap 92.

Figure 12:
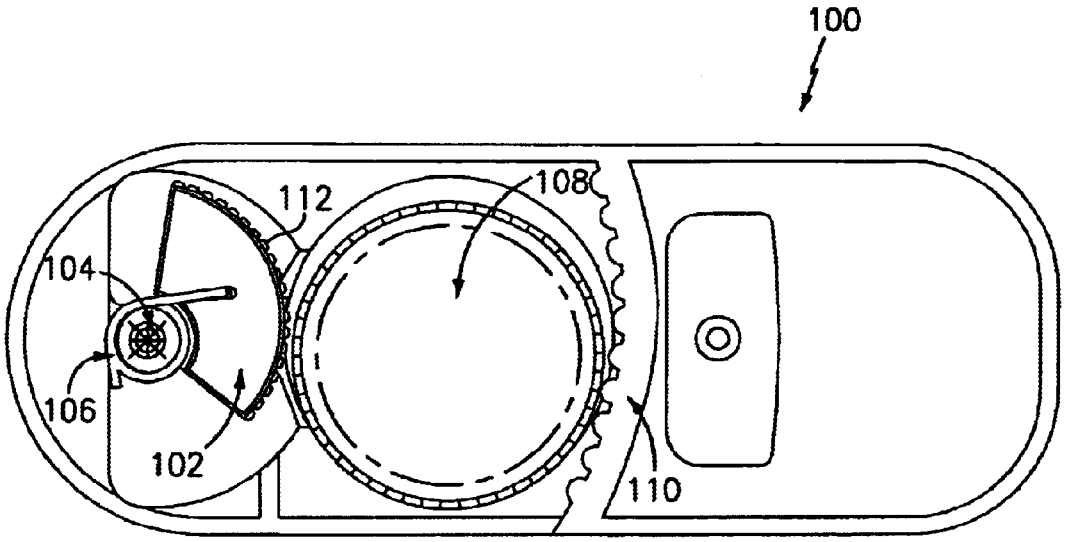

FIG. 12 describes a further alternative of the present invention which allows for the reduction in the number of component pieces as well as introducing an alternate direction of engagement between the opener and the bottle cap. Thus, FIG. 12 shows opener 100 which includes a single cam 102 and a spring loaded actuation as shown in FIG. 7, wherein cam 102 pivots about an integral boss 104 and is biased by a torsion spring 106. The opener engages the bottle cap 108 that is to be removed by approaching from the side against the top down approach described in the previous embodiments. Thus, as the bottle cap 108 approaches from the side (moving from bottom to top in FIG. 12), the bottle cap 108 encounters both the stationary gripping surface 110 and the cam 102 surface 112. As the bottle cap 108 is inserted further, the cam 102 is rotationally deflected, increasing the contact loading between the cam 102 and the bottle cap 108, as well as between the bottle cap 108 and the stationary gripping surface 110. As the opener 100 is rotated with respect to the bottle cap 108 in the same direction as for loosening said bottle cap, the relative motion causes a rotational movement of the cam 102 in a direction such that the pressure exerted upon the bottle cap 108 is increased. As the rotational motion is continued, the bottle cap 108 becomes tightly held, and further rotation of the device translates to a loosening rotation of the bottle cap.

Figure 13:
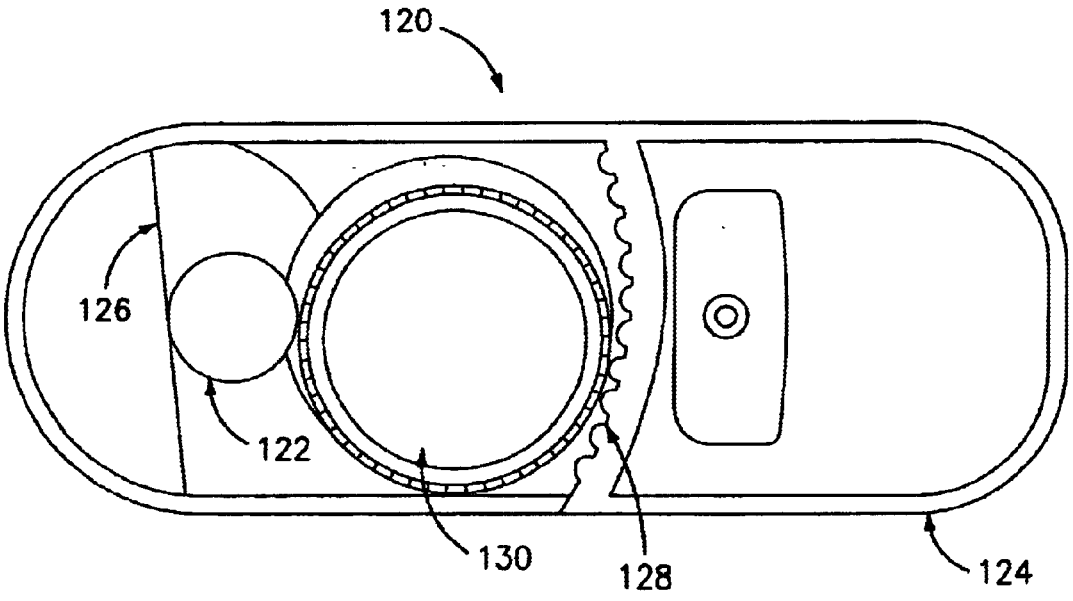

FIG. 13 describes a further alternative of the present invention which encompasses a simplification to the spring biased cam based mechanism described above. Thus, referring to FIG. 13, opener 120 replaces the cam system with a roughened cylinder or sphere 122 entrapped between the upper and lower housings, with FIG. 12 showing only the lower housing 124. Sphere 122 is free to roll up an inclined slope 126 which is fixed in the device housings. Opposing the aforesaid sphere 122 is a stationary, annular gripping surface 128 as in previous embodiments. As the opener 120 is engaged with a bottle cap 130 the roughened sphere 122 contacts the cap 130 and a load is applied perpendicular to the tangent line of contact. As the bottle cap 130 is rotated within the device, the sphere 122, which is free to roll up the inclined surface 126 transfers an increasing load to the cap 130, whereby the cap is efficiently and expeditiously caused to rotate and loosen.

If desired, more than one or two annular members may be readily provided circumferentially limited about the opening. Thus, for example, 2, 3 or more annular members may readily be provided in order to firmly engage the bottle cap and efficiently and expeditiously open same.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. Bottle cap removal device, which comprises:

a body having a portion with an opening therein for receiving the bottle cap, a first portion on one side of the open portion, and a second portion on the opposed side of the portion;

an annular member in at least one of said first and second portions for engagement with a bottle cap disposed in said open portion, and a surface opposed to said annular member for engagement with said bottle cap in opposition to said annular member; and means for applying increased gripping forces on said bottle cap by said annular member and opposed surface upon relative rotation between said annular member and bottle cap, wherein said annular member and said surface include at least one cam pivotably mounted around a fixed point of rotation and biased toward a reference position.

2. Device according to claim 1, wherein said body is an elongate body.

3. Device according to claim 1, including rotatable annular members in said first and second portions.

4. Device according to claim 3, wherein said annular members in said first and second portions are cams.

5. Device according to claim 4, wherein said cams pivot about bosses and are spring biased by torsion springs.

6. Device according to claim 5, including an engagement lever which encounters one cam and causes rotation thereof in opposition to spring forces generated by one of said springs.

7. Device according to claim 1, including a rotatable annular member in said first portion and a fixed annular body in said second portion.

8. Device according to claim 7, including a single rotatable annular member comprising a cam which pivots about a boss and is biased by a torsion spring.

9. Device according to claim 7, wherein said annular member is a cylinder or sphere.

10. Device according to claim 9, including an inclined slope adjacent said annular member, wherein said annular member is operative to roll up the inclined slope to firmly engage the bottle cap.

11. Device according to claim 1, wherein said body includes a base and top separable from each other, with said annular member and opposed surface situated therein.

12. Device according to claim 1, including a torsion spring operatively connected to said annular member to permit controlled motion of the annular member.

13. Device according to claim 1, including a leaf spring acting on the annular member and biasing said annular member towards the open portion.

14. Device according to claim 1, wherein said open portion is centrally located in said body.

* * * * *